United States Patent [19]

DiDominico et al.

[11] 4,061,943

[45] Dec. 6, 1977

[54] CATHODE RAY TUBE WITH SUPPORTED CONDUCTOR EXTENDING THROUGH EXHAUST TUBULATION

[75] Inventors: Mario A. DiDominico; Harry E. Smithgall, both of Seneca Falls, N.Y.

[73] Assignee: GTE Sylvania Incorporated, Stamford, Conn.

[21] Appl. No.: 715,177

[22] Filed: Aug. 16, 1976

[51] Int. Cl.[2] ..... H01J 29/02; H01J 5/46

[52] U.S. Cl. ..... 313/482; 313/456; 313/318

[58] Field of Search ..... 313/371, 381, 482, 384, 313/318 US, 477

[56] References Cited

U.S. PATENT DOCUMENTS

| | | | |
|---|---|---|---|
| 3,265,922 | 8/1966 | Verbeek | 313/318 |
| 3,751,703 | 8/1973 | Weijland et al. | 313/384 |
| 3,753,026 | 8/1973 | Goorissen | 313/318 |
| 3,763,390 | 10/1973 | Belknap | 313/318 |
| 3,885,185 | 5/1975 | Tilley | 313/318 |

*Primary Examiner*—Robert Segal
*Attorney, Agent, or Firm*—Norman J. O'Malley; Frederick H. Rinn; Robert T. Orner

[57] ABSTRACT

An electrical connective improvement is provided for a multiple-element electron gun assembly in an electron tube. The improvement relates to an isolated electrical conductor extending within the envelope from one of the elements of the electron gun assembly to the closure portion of the tube, whereat the conductor is shaped to project into and be encompassed by the exhaust tubulation wherein a portion of the conductor is sealed. Removal of the exterior portion of the tubulation beyond the seal provides an electrical connection extending exteriorly thereof.

2 Claims, 7 Drawing Figures

CATHODE RAY TUBE WITH SUPPORTED CONDUCTOR EXTENDING THROUGH EXHAUST TUBULATION

CROSS REFERENCE TO RELATED APPLICATION

This application contains matter disclosed but not claimed in a related U.S. patent application filed concurrently herewith and assigned to the assignee of the present invention. This related application is Ser. No. 715,176.

BACKGROUND OF THE INVENTION

This invention relates to electrical connective means for an electron discharge device and more particularly to an improved closure-oriented electrical conductive means for a multiple element electron tube.

Conventionally an electron tube includes an evacuated envelope wherein an electron gun assembly, having elements for generating and controlling electrons, is usually supported by a plurality of leads hermetically sealed into a wafer-like closure member in a manner to traverse therethrough to provide electrical connections to associated external circuitry. These supportive and connective leads are usually in the form of metallic pins conventionally spaced in a vertical array and extended through the closure member in a manner to conserve space, thereby keeping the physical magnitude of the electron tube structure to a desirable minimal size. Such compactness often creates a constructional problem in achieving the desired degree of electrical isolation of the respective pins, several of which individually conduct electrical potentials of differing levels.

In certain types of electron tubes, such as for example, in cathode ray tubes, it is often necessary to orient one or more high voltage connections through the closure portion of the tube. The presence of high voltage differentials between adjacent pins in the conventional connective array is conducive for the development of voltage breakdown and resultant arcing in addition to leakage across the glass surface of the closure member between pins. The development of leakage and arcing conditions produces deleterious and sometimes catastrophic effects, both interiorly and exteriorly of the tube, thereby markedly interfering with the intended operation of the device.

OBJECTS AND SUMMARY OF THE INVENTION

It is an object of the invention to reduce and obviate the aforementioned disadvantages evidenced in the prior art. Another object of the invention is to provide improved isolation for additional electrical conductive means traversing the closure member. A further object of the invention is to provide an improved electron tube having at least one high voltage lead discretely traversing the closure member thereof.

These and other objects and advantages are achieved in one aspect of the invention wherein there is provided an electrical connective improvement for a multiple-element electron gun assembly in an electron tube wherein the assembly is supported by an array of metallic pins traversing a closure member having an axially oriented exhaust tabulation therein. Some of the elements of the electron gun assembly have individual electrical connections to certain of the respective pins in the closure-oriented array. The improvement of the invention relates to a separate electrical conductive means extending within the envelope from one of the elements of the electron gun assembly to the closure member, whereat the terminal portion of the conductor is shaped to spatially project into and be encompassed by the exhaust tubulation wherein a hermetic glass-to-metal seal is effected. Subsequently, the exterior portion of the tubulation extending beyond the seal area is removed to provide an electrical conductor extending exteriorly of the seal.

DESCRIPTION OF THE PREFERRED EMBODIMENTS

For a better understanding of the present invention, together with other and further objects, advantages and capabilities thereof, reference is made to the following specification and appended claims in connection with the aforedescribed drawings.

Figure 1:
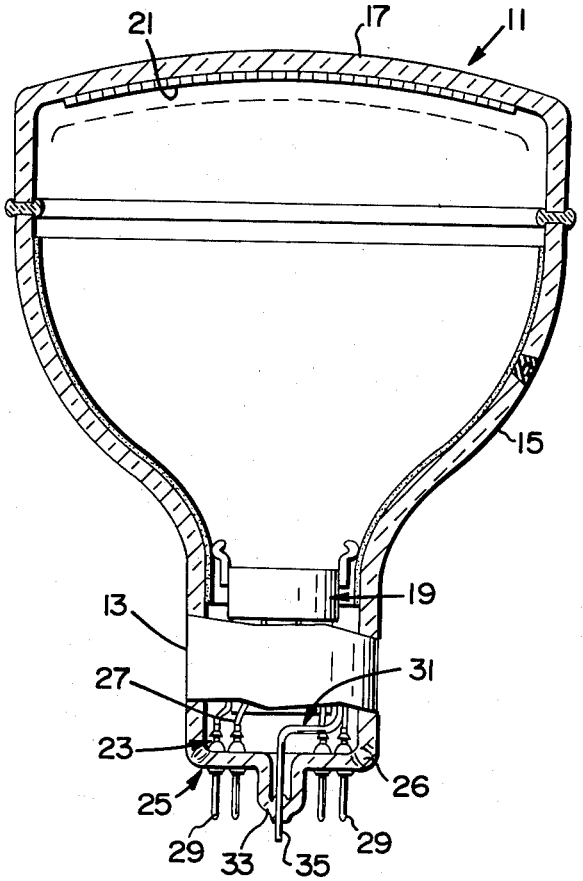
FIG. 1 is an illustration of a cathode ray tube partially sectioned to show the environment wherein the improvement of the invention is oriented.

With reference to the drawings, there is shown in FIG. 1 an example of an electron tube, such as a cathode ray tube, wherein the conductive means of the invention is utilized. It is not intended that the invention be limited to the example delineated. The exemplary cathode ray tube 11 has an encompassing envelope comprised of an integration of a neck portion 13, a funnel portion 15, and a face or viewing panel portion 17. Positionally encompassed within the neck portion is a multi-element electron gun assembly 19 from which one or more electron beams are projected toward the screen 21. Details of the several electrode elements comprising the gun assembly are not shown, as the invention per se is not concerned with their explicit constructions or relationships. An array of metallic connective leads or pins 23 traverse the glass closure portion 25 of the envelope and, as such provide internal supportive means 27 for the electron gun assembly 19 and external connective means 29 for the same. A separate and discretely shaped electrical conductor 31 from the assembly is shown as positioned and sealed within the axial exhaust tubulation 33 of the tube to provide an axially-oriented electrical connection 35 for the assembly.

Figure 2:
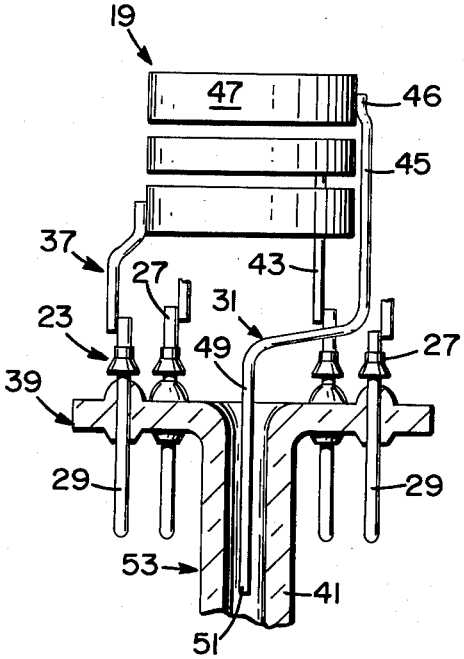
FIG. 2 is a sectional view illustrating the conductive means of the invention attached to an element of a fragmented electron gun assembly supported upon a wafer-type closure member.

For a more detailed description of the invention, attention is directed to FIG. 2 wherein there is shown an electron tube gun-stem assembly 37. As previously mentioned, the explicit details of the electron gun assembly 19 are not indicated, therefore, the multiple elements shown are merely exemplary manifestations of a plurality of related electrodes. The gun assembly is suitably supported on a circular array of metallic pins 23 of which only four are shown for purposes of clarity. These pins traverse a closure element in the form of a glass wafer-like stem member 39 having an axially oriented exhaust tubulation 41 extending exteriorly therefrom. This stage in tube construction is often referred to as the electron gun mount assembly, and represents the gun structure prior to placement within the neck portion 13 whereupon the neck-closure seal 26 is effected. Some of the elements of the gun structure 19 have individual electrical connections 43 to the respective pins in the wafer closure member 39.

Figure 6:
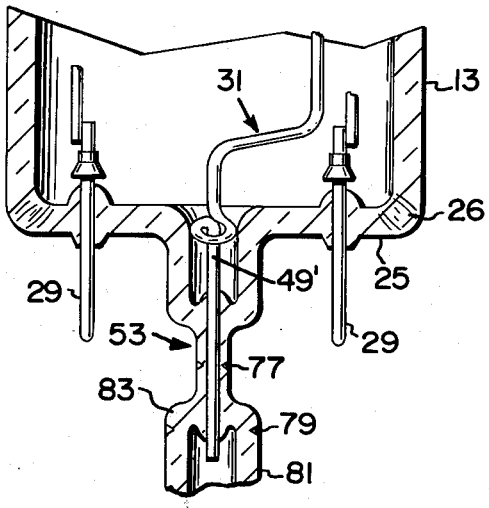
FIG. 6 is a partially sectioned view showing the sealing of the electrical conductive means in the exhaust tubulation.

The connective improvement of the invention concerns a separate electrical conductive means 31 in the form of a connective lead exhibiting an exemplary diameter in the order of 0.5 to 1.0 mm and having a proximal section 45, the terminus 46 thereof being attached to one of the electrode elements 47 of the electron gun assembly 19. This proximal section of the conductor is formed to extend in an insulative spatial manner to the region of the stem wafer 39 whereat a distal section 49 of the conductor is discretely shaped to have a distal terminus 51 projecting into and be encompassed by the hollow exhaust tubulation 41. The distance that the distal portion of the conductive means projects into the exhaust tubulation is such that the distal terminus 51 thereof extends beyond the subsequent seal area 53 of the tubulation, as illustrated in FIG. 6. The special conductive means is formed of a metallic material that manifests sufficient shaped-rigidity to maintain spatial orientation within the exhaust tubulation prior to subsequent sealing as shown in FIG. 2. Suitable connective materials are conventional in the art, such as nickel, steel, and alloys thereof. It is important that at least a portion of the distal section 49 be of a material that forms a compatible seal with the glass of the tubulation; suitable materials of this category are also well known in the art. If the electron gun environment necessitates, all or a portion of the proximal section of the conductor is encapsulated with an insulative substance 55, such as a glass or ceramic material, as shown in FIG. 3.

Figure 3:
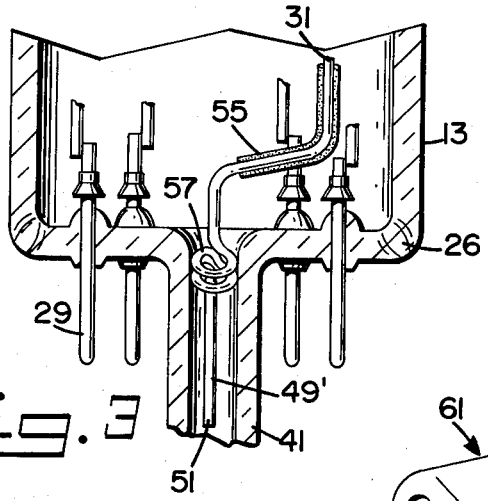

In addition to maintaining spatial alignment within the exhaust tubulation by formed rigidity, another positioning embodiment is shown in FIG. 3 wherein the distal section 49' of the conductive means is shaped to have a helix 57 of at least one turn formed in that portion positioned immediately within the open tubulation 41 in a manner substantially make internal circumferential contact with the interior surface of the tubulation, thereby substantially effecting centering of the distal portion 49 of the conductor 31 therein.

Figure 4:
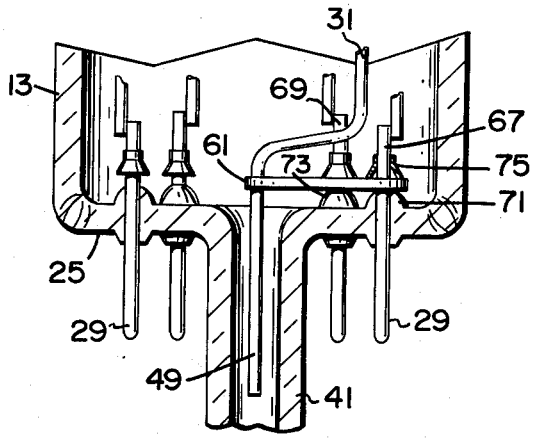
FIGS. 3, 4 and 5 illustrate additional embodiments of the invention.
Figure 5:
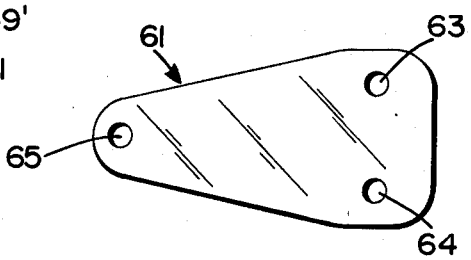

An additional centering and positioning embodiment is illustrated in FIGS. 4 and 5, wherein an apertured insulative member 61 having at least three holes 63, 64 and 65 therein, is associated with at least two adjacent pins 67, 69 of the circular array. The pin-related apertures 63 and 64 in the insulative member 61 are of a size and spatial orientation to accommodate placement of the member on the respective pins 67 and 69, whence the insulative member is seated on the glass bead formations 71 and 73 surrounding the leads 67 and 69 in the closure member 25. Conventional shields 75 are abutted against the member 61 to maintain positive positioning. The third aperture 65 in the insulative member, as shown in FIG. 5, is of a size and spatial placement to effect positive and insulative positioning of the conductive means within the exhaust tubulation 41.

Figure 7:
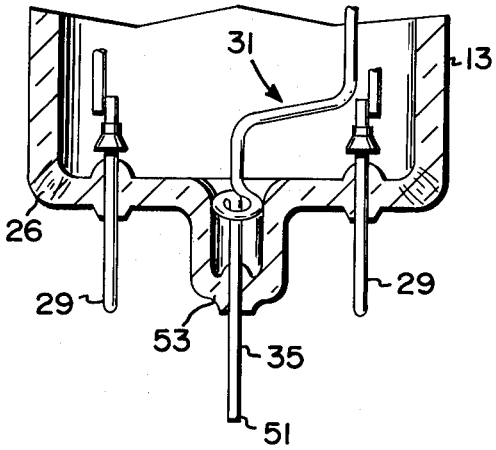
FIG. 7 is a partial sectional view showing the axial oriented lead of the invention projecting from the sealed tube.

With the axial conductive means 31 spatially oriented within the exhaust tubulation 41, as shown in FIGS. 3 and 4, tube processing is then instituted. To consummate processing, the open exhaust tubulation is connected to a gas evacuating system, not shown, whereupon heat is applied to the internal elements of the tube to expedite degassing thereof. This evacuation procedure is continued until the desired level of internal pressure is achieved; at which time, a concentration of heat, such as a gas tipping flame, not shown, is applied to a specific section of the exhaust tubulation 53 encompassing the connective means 31 to form a constricture of the tubulation thereat. As the glass in the seal area softens during the tipping operation, the wall of the tubulation collapses under the influence of atmospheric pressure forcing the softened glass to surround the connective means thereby effecting a vacuum-tight hermetic glass-to-metal seal embedding and supporting the distal section of the conductive means substantially axially therein, as shown in FIG. 6. The glass is then cooled to harden the seal area 53, whereupon a first scribe mark 77 is scored on the surface of the seal area in a manner to substantially bisect the seal. A second scribe mark 79 is scored on the surface of the tubulation 41 at substantially the intersection of the seal and the extremital portion of the tubulation. The glass of the seal-tubulation area, at substantially the mark of the second scribing, is shocked by either mechanical or thermal means to remove the extremital portion 81 of the tubulation. The glass immediately below the first scribe mark 77 on the seal area 53 is then thermally shocked, as by a fine sharp flame, to cause the end section 83 of the seal to shatter thereby freeing and exposing the terminal portion 51 of the conductive means such as shown in FIG. 7. Thus, there is provided an axially oriented external electrical connection 35 for the electron tube device that is an expedient isolated means for effecting a high voltage connection through the closure member 25 of the tube 11.

While there has been shown and described what are at present considered the preferred embodiments of the invention, it will be obvious to those skilled in the art that various changes and modifications may be made therein without departing from the scope of the invention as defined by the appended claims.

What is claimed is:

1. An improvement in a cathode ray tube embodying a screen supporting envelopic enclosure wherein a multi-element electron gun assembly is electrically connected with and supported upon a circular array of metallic pins traversing a glass closure portion of said envelope having an axially located hermetically sealed exhaust tubulation therein, said improvement comprising:

a separate electrical conductive means having a proximal section attached to one of said elements, the proximal section of said conductor being spatially positioned to extend to said closure portion whereat a distal section of said conductor is extended into said tubulation, said conductor being significantly smaller in cross section than the diameter of said tubulation and integrated into the hermetic seal thereof in a manner to traverse said seal thereby providing an axially oriented external electrical connection for said device; and an apertured insulative member positioned within said tube above the glass closure portion thereof, said insulative member having at least three apertures therein, two of said apertures being of a size and orientation to accommodate the placement of said member on two of said pins in said circular array, a third aperture being spaced therefrom to effect positive and insulative positioning of said conductor in said tubulation.

2. The improvement in an electron tube according to claim 1 wherein at least a portion of the proximal section of said axially oriented conductive means has insulation disposed thereon.

* * * * *